United States Patent [19]

Bussjager et al.

[11] 4,157,649

[45] Jun. 12, 1979

[54] MULTIPLE COMPRESSOR HEAT PUMP WITH COORDINATED DEFROST

[75] Inventors: Rudy C. Bussjager, Syracuse; James J. Del Toro, Liverpool, both of N.Y.

[73] Assignee: Carrier Corporation, Syracuse, N.Y.

[21] Appl. No.: 889,695

[22] Filed: Mar. 24, 1978

[51] Int. Cl.[2] ..... F25B 41/00; F25B 13/00; F25B 7/00; F25B 1/10

[52] U.S. Cl. ..... 62/81; 62/160; 62/324; 62/335; 62/510

[58] Field of Search ..... 62/81, 160, 324, 335, 62/510

[56] References Cited

U.S. PATENT DOCUMENTS

| | | | |
|---|---|---|---|
| 2,241,060 | 5/1941 | Gibson | 62/160 |
| 2,692,481 | 10/1954 | Schweller | 62/335 |
| 2,796,743 | 6/1957 | McFarlan | 62/324 R |
| 3,750,415 | 8/1973 | Peuchen et al. | 62/324 R |
| 4,040,268 | 8/1977 | Howard | 62/510 |

*Primary Examiner*—Lloyd L. King

*Attorney, Agent, or Firm*—J. Raymond Curtin; Robert P. Hayter

[57] ABSTRACT

A method and apparatus for controlling a multiple compressor heat pump system such that when the system is in the heating mode of operation the compressors are cycled individually depending upon the ambient temperature level and are individually co-ordinately operated in a defrost mode. The electrical control means disclosed provides for a second compressor being energized when the outdoor heat exchanger of a first compressor is being defrosted and the first and second contact means located within the individual defrost circuits for the first and second outdoor heat exchangers such that when the first outdoor heat exchanger is being defrosted the second outdoor heat exchanger may not commence a defrost cycle and when the second compressor is being operated in a defrost cycle a first compressor may not commence a defrost cycle.

15 Claims, 2 Drawing Figures

MULTIPLE COMPRESSOR HEAT PUMP WITH COORDINATED DEFROST

BACKGROUND OF THE INVENTION

1. Field of the Invention

This invention relates to a heat pump control and more particularly to a control system for coordinately regulating the defrost operation of a dual compressor heat pump system.

2. Description of the Prior Art

The utilization of a dual compressor heat pump is advantageous for being able to independently stage the compressors to control the energy input required for necessary cooling and heating operations. The term heat pump as used herein refers to a reversible refrigeration system capable of delivering on demand either heating or cooling to a region to be conditioned. In most smaller heat pump systems, a single compressor is employed. Control of these single compressor systems is relatively simple and presents few problems. However, in many larger heat pump systems two compressors are utilized with each compressor arranged to pump refrigerant through an associated closed loop circuit.

In heat pump systems using two compressors, it is the common practice to stage the operation of compressors when the heat pump is in the cooling mode of operation whereby the compressors are brought into operation in sequence as the cooling load of the system increases. However, both compressors are normally operated when the system is providing heating to the air conditioned region without regard to the heating demands placed on the system. The operation of both of the compressors in the heating mode is carried out primarily to prevent an inadvertent cycling load on the compressors when the system is undergoing a defrost cycle. As is well known in the art starting one of the compressors when the outdoor fan is off as is typical during defrost will force the system to operate under adverse conditions which could damage the system.

The continuous operation of both compressors to avoid the problems associated with defrosting, however, gives rise to other problems which, although not as dramatic, can also lead to needless wasting of energy and eventual failure of the system. In United States patent application, Ser. No. 739,398, now abandoned entitled, "Two Stage Compressor Heating" assigned to the assignee hereof and having the same inventors as herein, there is disclosed a heat pump control system for staging the operation of the dual compressor system in the heating mode of operation. Therein is shown an electrical circuit involving a defrost system wherein one compressor or two compressors may be operated to meet the heating load as sensed by a thermostat. Therein it is disclosed that when defrost is necessary both outdoor heat exchangers will be simultaneously defrosted. By averaging the refrigerant temperatures in each system the necessity of defrost is determined. If only one compressor is in operation, then the other compressor will be energized such that both operate in a cooling mode when defrost is required.

The present system concerns itself with the staged operation of a dual compressor system in the heating mode of operation as well as independent defrost of the separate outdoor heat exchangers. The electrical control circuit provided energizes the second compressor when the first compressor is in a defrost cycle such that heating is supplied to the region to be conditioned notwithstanding that the second compressor is operated in the cooling mode to defrost the outdoor heat exchanger. Furthermore, individual relay contacts are provided in each defrost system such that if either of the compressors is being operated in a defrost cycle, the other compressor may not commence its defrost cycle. Consequently, in the heating mode of operation one compressor is always supplying heat to the enclosure or region to be conditioned notwithstanding the mode of operation of the other compressor.

SUMMARY OF THE INVENTION

It is an object of the present invention to provide a heat pump control for a multiple compressor heat pump system.

It is a further object of the present invention to provide a control system such that the heat pumps may be independently staged in the heating mode of operation.

It is a further object of the present invention to provide a multiple compressor heat pump unit wherein the operation of each compressor is regulated such that only one compressor may be in the defrost mode of operation at any one time.

It is a yet further object of the present invention to reduce the amount of energy consumed by heat pump units employing multiple compressors.

It is a still further object of the present invention to provide a dual compressor heat pump system wherein the second compressor is activated to supply heating to the area to be conditioned notwithstanding the loading conditions when the first compressor is in a defrost mode of operation.

It is another object of the present invention to operate both compressors of a dual heat pump system upon an initial heating demand when the outdoor ambient temperature is below a predetermined level.

It is a yet further object of the present invention to provide a reliable, economical and durable control system for regulating a multiple compressor heat pump system.

These and other objects will be apparent from the description to follow and the appended claims.

The preceding objects are achieved according to the present invention by the provision of a heat pump system having first and second compressors, a first indoor heat exchanger and a second indoor heat exchanger, said heat exchanger being utilized to provide heating and cooling to a conditioned region. First and second outdoor heat exchangers are operatively connected to the appropriate compressor and indoor heat exchanger to form a closed fluid refrigeration circuit. First and second defrost means for removing accumulated ice from the outdoor heat exchangers, thermostat means for activating the compressors at the appropriate temperature levels and a first control circuit which when energized activates the first defrost means to initiate a defrost cycle for the first outdoor heat exchanger operatively connected to the first compressor and which overrides the thermostat to effect starting of the second compressor regardless of the temperature within the conditioned region; and a second defrost control circuit which when energized activates the second defrost means to initiate a defrost cycle for the second outdoor heat exchanger operatively connected to the second compressor are further provided. A first defrost relay set of normally closed contacts connected to the first defrost control circuit to prevent initiation of a defrost cycle when the second defrost control circuit is in a defrost cycle, and a second defrost relay set of contacts in a normally closed position connected to the second defrost control circuit to prevent the initiation of a defrost cycle when the first defrost circuit is in a defrost cycle are utilized. Relay circuits are further provided to de-energize the reversing valves and appropriate outdoor heat exchanger fans when the unit is operated in the defrost mode of operation. An outdoor thermostat connected to a heating relay is further provided such that when the ambient temperature level is below a predetermined point all compressors are operated simultaneously at the appropriate indoor temperature level. Supplementary heat is thereafter initiated upon a further change in indoor temperature level.

DESCRIPTION OF THE PREFERRED EMBODIMENT

The embodiment as described below is particularly adapted for use with a dual compressor heat pump system. It is within the spirit and scope of this invention that the description to follow would apply to all types of multiple compressor heat pumps utilizing independent defrost cycles for separate outdoor heat exchangers associated therewith. The size, load requirements and end use of individual heat pump systems will not affect the scope of the invention as hereinafter described.

Figure 1:
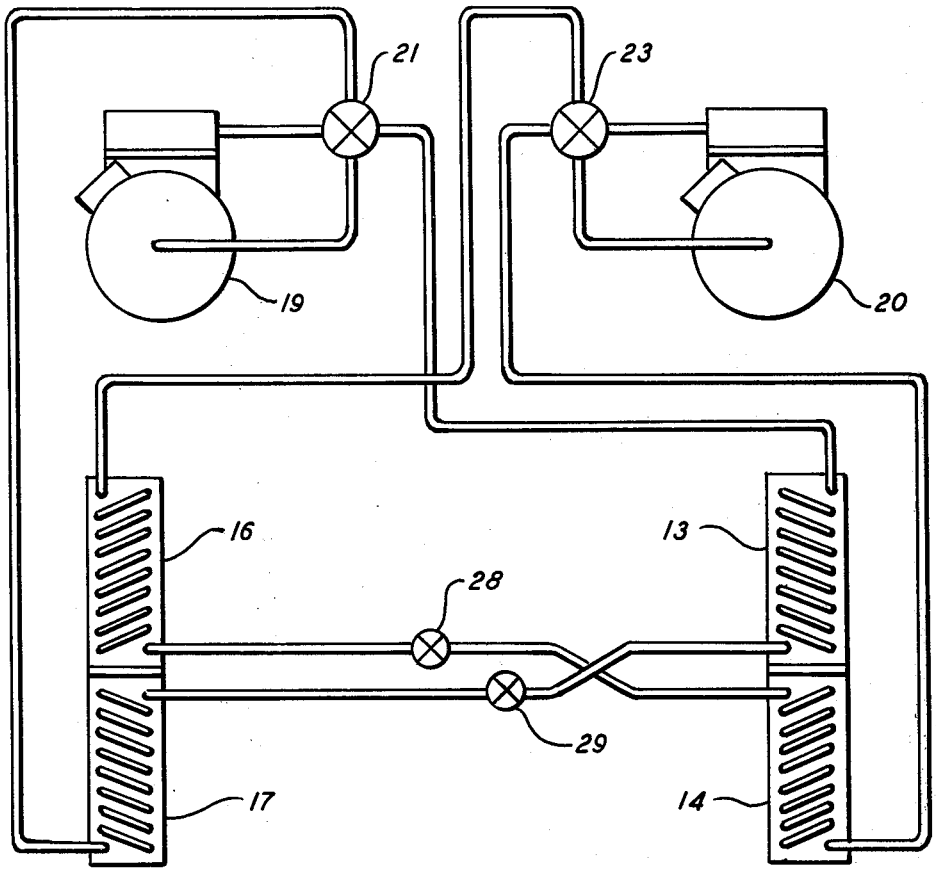
FIG. 1 is a schematic representation of a heat pump unit employing two compressors, two indoor heat exchangers and two outdoor exchangers.

Referring to the drawings it can be seen in FIG. 1 that compressor 19 is connected through reversing valve 21 to indoor heat exchanger 17 and outdoor heat exchanger 13. It can also be seen that compressor 20 is connected through reversing valve 23 to indoor heat exchanger 16 and outdoor heat exchanger 14. Expansion valves 28 and 29 are shown in the circuitry connecting the indoor and outdoor heat exchanger for each compressor.

In the cooling mode of operation the reversing valves provide for a flow of hot gaseous refrigerant to the outdoor heat exchanger wherein the gaseous refrigerant is condensed to a liquid. From the outdoor heat exchanger the condensed liquid flows is throttled through an expansion valve undergoing a decrease in pressure. The refrigerant then changes state to a vapor in the indoor heat exchanger absorbing heat from the air passing over the heat exchanger. The now gaseous refrigerant is then returned to the compressor to complete the cycle.

In the heating mode of operation the compressed gaseous refrigerant is conducted first to the indoor heat exchanger where it is condensed from a gas to a liquid giving up the heat of condensation to the region to be conditioned. From the indoor heat exchanger, the liquid refrigerant then passes through the expansion valve to the outdoor heat exchanger where it is evaporated absorbing heat from the outdoor air before it is conducted back to the compressor as a gas. Each heat pump circuit within the system operates in the same manner.

Figure 2:
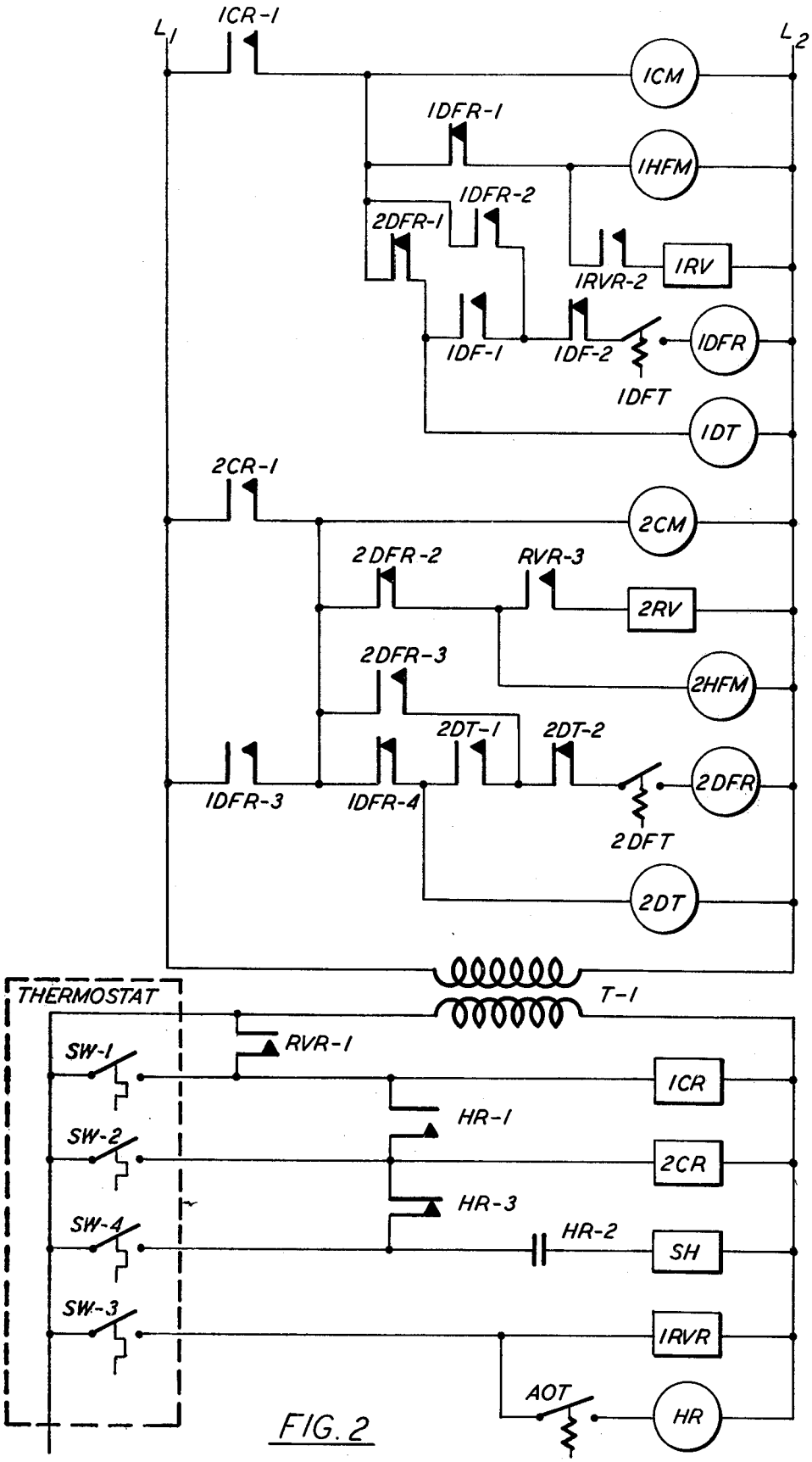
FIG. 2 is an electrical diagram of illustrating circuit means for regulating the operation of the compressors utilized in the heat pump system shown in FIG. 1.

Referring now to FIG. 2, it can be seen that line voltage is supplied through $L_1$ and $L_2$ to the electrical circuit as shown. The compressor motors (usually 3 phase and being connected across three wires but shown with only one connection to keep the drawing legible) designated 1CM and 2CM are connected across the line voltage by relay contacts 1CR-1 and 2CR-1. Relay contacts 1CR-1 are connected to compressor motor 1CM, to normally closed first defrost relay contacts 1DFR-1, to normally open first defrost relay contacts 1DFR-2 and to normally closed second defrost relay contacts 2DFR-1. The 1DFR-1 relay contacts are connected to the first outdoor heat exchanger fan motor 1HFM, and to RVR-2, the normally open reversing valve relay contacts. The normally open reversing valve relay contacts are connected to 1RV, the first reversing valve. The 1DFR-2 contacts are connected to the normally open 1DT-1 and normally closed 1DT-2 defrost timer contacts. The 2DFR-1 normally closed contacts are connected to the 1DT-1 contacts and first defrost timer, 1DT. The normally closed 1DT-2 relay contacts are connected to 1DFT, the first defrost thermostat, which is connected to the first defrost relay, 1DFR.

The 2CR-1 relay contacts and the first defrost relay, 1DFR-3, contacts are both connected to the second compressor motor, 2CM, normally closed second defrost relay contacts 2DFR-2, the normally open second defrost relay contacts 2DFR-3 and the normally closed first defrost relay contacts 1DFR-4. The 2DFR-2 contacts are connected to the second outdoor heat exchanger fan motor 2HFM and to the normally open reversing valve relay, RVR-3, contacts. The RVR-3 contacts are connected to the second reversing valve, 2RV. The second defrost relay contacts 2DFR-3, are connected to the second defrost timer normally open contacts 2DT-1 and the second defrost timer normally closed contacts 2DT-2. The 1DFR-4 contacts are connected to the normally open 2DT-1 contacts and the second defrost timer, 2DT. The normally closed 2DT-2 contacts are connected to the second defrost thermostat, 2DFT, which is connected to the second defrost relay, 2DFR.

A transformer, T-1 supplies a control current to the control section of the circuit from the line section of the circuit. Within the control section of the circuit is a thermostat having a series of four switches SW-1 through SW-4. Thermostat switch SW-1 is connected to normally open reversing valve relay contacts RVR-1, normally open heating relay contacts HR-1 and first compressor relay 1CR. Normally open thermostat switch SW-2 is connected to normally open relay contacts HR-1, normally closed heating relay contacts HR-3 and second compressor relay 2CR. Normally open thermostat switch SW-4 is connected to normally closed heating relay contacts HR-3 and normally open heating relay contacts HR-2 which are connected to supplementary heat source SH, typically electric resistance heaters. Normally open thermostat switch SW-3 is connected to the reversing valve relay, RVR and the adjustable outdoor thermostat, ADT, which is connected to heating relay HR. The RVR-1 contacts are connected to the transformer T-1, normally open thermostat switch SW-1, the first compressor relay 1CR and normally open heating relay contacts HR-1.

During operation, the first thermostat switch SW-1 is closed upon sensing a cooling need and the first compressor relay 1CR is energized activating the first compressor motor, when an additional cooling need is sensed switch SW-2 is closed and relay 2CR is energized activating the second compressor motor. During cooling operation defrost is not necessary and consequently the remainder of the circuitry is not utilized.

In the heating mode of operation, switch SW-3 is closed upon a heating need being sensed which energizes reversing valve relay and closes the appropriate reversing valve relay contacts. RVR-1 contacts close energizing the first compressor relay which consequently energizes the first compressor motor. RVR-2 is also energized by the reversing valve relay such that the first reversing valve is energized and the first compressor system operates in the heating mode of operation. During operation, the first defrost timer is energized through the 2DFR-1 normally closed contacts. Upon a predetermined elapsed period the first defrost timer closes 1DT-1 contacts and allows the 1DT-2 contacts to remain closed for a selected defrost period such as 10 minutes. If the first defrost thermostat 1DFT senses a need for defrost, by ascertaining the refrigerant temperature or utilizing some other means to detect an ice accumulation on the outside coil, the first defrost thermostat will then close and consequently during the period when both 1DT-1 and 1DT-2 are closed the first defrost relay will be energized. Once the first defrost relay is energized the 1DFR-1 contacts open discontinuing operation of the first outdoor heat exchanger fan motor and de-energizing the first reversing valve such that the system will be operated in the cooling mode of operation supplying heat to the outdoor coil. The first defrost relay-2, contacts, 1DFR-2 will be closed such that a current path is provided to continually energize the first defrost relay until such time as the defrost thermostat senses a no ice condition and opens. At that time, the first defrost relay will be de-energized and the first defrost relay-2 contacts will open thereby terminating defrost operation until such time as the defrost timer initiates another sequence to ascertain if the defrost thermostat is closed. The 2DFR-1 normally closed relay contacts are provided such that the first defrost timer cannot be activated if the second defrost relay, the defrost relay in the second compressor circuit, is energized indicating that the second circuit is in the defrost cycle. Defrost will also be terminated upon the expiration of the delay period such that the defrost timer opens the 1DFT-2 contacts deenergizing the first defrost relay.

The operation of the second compressor circuit is similar to that of the first. Upon an additional heating need being sensed, SW-4 closes energizing through the closed HR-3 contacts the second compressor relay. Consequently, the 2CR-1 contacts are closed which energizes the second compressor motor. The second compressor motor may also be energized through the 1DFR-3 contacts. When the first compressor is being operated in the defrost mode of operation, the first defrost relay will operate to close the 1DFR-3 contacts and consequently the second compressor motor will be operated such that heating will be supplied to the indoor coil from the second compressor notwithstanding the operation of the first compressor motor in the cooling mode of operation for defrost purposes. When either the 2CR-1 or the 1DFR-3 contacts are energized, the second outdoor heat exchanger fan motor 2HFM will be energized through normally closed contacts 2DFR-2. The second reversing valve will be energized through the normally closed contacts 2DFR-2 and the closed reversing valve relay contacts RVR-3. The second defrost timer will be energized through normally closed first defrost relay-4 contacts such that upon the expiration of a predetermined period the 2DT-1 contacts will be closed for a predetermined period while the 2DT-2 contacts remain in a closed position. The 2DT-1 contacts will remain closed for approximately 10 seconds after the second defrost timer is tripped during which time if the second defrost thermostat is closed, the second defrost relay will be energized. When the second defrost relay is energized the 2DFR-2 contacts are opened thereby de-energizing the second reversing valve and the second outdoor heat exchanger fan motor. The 2DFR-3 contacts will be closed thereby providing a closed circuit through the 2DT-2 contacts and through the second defrost thermostat to continually energize the second defrost relay 2DFR. When the second defrost thermostat senses that there is no longer a need for defrost it will open thereby discontinuing operation of the second defrost relay. The 2DT-2 contacts will open after the expiration of a preset period such as 10 minutes to terminate defrost in any event. The 1DFR-4 contacts are so arranged that when the first compressor is in the defrost mode of operation, the 1DFR-4 contacts are open and consequently no current is provided to the second defrost timer such that it may not initiate a defrost cycle. These contacts serve the same purpose as the 2DFR-1 contacts in the first compressor circuit.

An adjustable outdoor thermostat AOT is provided such that system operation can be varied when the outdoor ambient temperature is below a predetermined level. When the outdoor thermostat is closed then heating relay HR is energized upon switch SW-3 being closed. Consequently the HR-1 and HR-2 contacts are closed and the HR-3 contacts opened. The now closed HR-1 contacts energize 2CR simultaneously with 1CR such that upon an initial heating demand both compressors are operated simultaneously to supply heat to the area to be conditioned. Upon a further drop in indoor temperature SW-4 is closed and the supplementary heaters, typically electric resistance heaters, are energized. The HR-3 contacts are open consequently the operation of the supplementary heat is independent of compressor operations. The net effect of the heating relay is to switch the heat pump system based on outdoor ambient temperature from staged compressor operation to staged operation between the compressors and the supplemental heaters.

An electrical control circuit has been disclosed which provides in the heating mode of operation for the staging of the compressor motors such that the first compressor may be operated alone when the heating load may be satisfied thereby and such that the second compressor may be operated when the load increases. It is further provided that the first compressor motor control circuit has means for energizing the second compressor motor when the first compressor motor is operated in defrost mode such that heat will be continually supplied to the region to be conditioned. Individual relay contacts are provided in each circuit such that the first defrost relay when energized will deactivate the second defrost relay and vice versa such that only one outdoor heat exchanger may be defrosted at any particular time.

The above invention has been disclosed with reference to a particular description herein. It is to be understood that variations and modifications can be made within the spirit and scope of the following claims.

What is claimed is:

1. A heat pump system utilizing a refrigerant having first and second compressors operatively connected to first and second indoor heat exchangers providing heating and cooling to a conditiond region and first and second outdoor heat exchangers, first and second defrost means arranged to remove ice from the outdoor heat exchangers and thermostat means to actuate the compressors at the appropriate temperature levels, the improvement comprising:

a first defrost control circuit, which when energized during operation of the first compressor, activates the first defrost means to initiate a defrost cycle for the first outdoor heat exchanger operatively connected to the first compressor and which effects starting of the second compressor independent of the temperature within the conditioned region;

a second defrost control circuit which when energized activates the second defrost means to initiate a defrost cycle for the second outdoor heat exchanger operatively connected to the second compressor;

first contact means connected to the first defrost control circuit to prevent the initiation of a defrost cycle when the second defrost control circuit is in a defrost cycle; and second contact means connected to the second defrost control circuit to prevent the initiation of a defrost cycle when the first defrost circuit is in a defrost cycle.

2. The apparatus as set forth in claim 1 wherein the first defrost control circuit includes a first defrost relay which is energized when the first defrost control circuit is energized and wherein the first contact means is a normally closed set of first defrost relay contacts in series with second defrost control circuit, said contacts opening upon initiation of defrost in the first defrost circuit thereby preventing the initiation of defrost in the second defrost control circuit.

3. The apparatus as set forth in claim 2 and wherein a set of normally open first defrost relay contacts are connected to the second compressor such that upon the initiation of defrost by the first defrost control circuit the second compressor is energized.

4. The apparatus as set forth in claim 1 wherein the second defrost control circuit includes a second defrost relay which is energized when the second defrost control circuit is energized and wherein the second contact means is a normally closed set of second defrost relay contacts in series with the first defrost control circuit said contacts opening upon initiation of defrost in a second defrost circuit thereby preventing the initiation of defrost in the first defrost control circuit.

5. The apparatus as set forth in claim 1 and further including first and second reversing valves to alter the flow of refrigerant through the heat exchangers and a first and second fan powered by separate motors for circulating air about the outdoor heat exchangers wherein, upon initiation of defrost by the first defrost control circuit the first fan is de-energized and the first reversing valve is automatically switched to the cooling mode of operation and upon initiation of defrost by the second defrost control circuit, the second fan is de-energized and the second reversing valve is automatically switched to the cooling mode of operation.

6. The apparatus as set forth in claim 1 and further including:

outdoor temperature detection means; and circuit means including contacts controlled by a relay energized by the outdoor temperature detection means such that below a predetermined outdoor temperature level the compressors of the heat pump system are operated simultaneously.

7. The apparatus as set forth in claim 6 and further including:

supplemental heaters connected to the circuit means such that the supplemental heaters are energized at the appropriate temperature level by the thermostat means when outdoor temperature is below a predetermined level.

8. A heat pump system having multiple compressors, first multiple heat exchangers at least one connected to each compressor to supply heating or cooling to an area to be conditioned, second multiple heat exchangers, and further comprising:

a first compressor control circuit having contact means to energize a first compressor and defrost means including a first defrost relay for activating a defrost cycle to defrost a first outdoor heat exchanger;

a second compressor control circuit having contact means to energize a second compressor and defrost means including a second defrost relay for activating a defrost cycle to defrost a second outdoor heat exchanger;

first contact means energized by the first defrost relay to energize the second compressor when the defrost cycle for the first outdoor heat exchanger is activated;

second contact means energized by the first defrost relay to de-energize the second defrost relay preventing a defrost cycle for the second outdoor heat exchanger when a defrost cycle for the first outdoor heat exchanger is activated; and third contact means energized by the second defrost relay to de-energize the first defrost relay preventing a defrost cycle of the first outdoor heat exchanger when a defrost cycle for the second outdoor heat exchanger is activated.

9. The apparatus as set forth in claim 8 wherein the first and second compressor control circuits each include a defrost timer and a defrost thermostat such that a defrost cycle is initiated at timed intervals when the defrost thermostat is closed indicating ice accumulation on the outdoor heat exchanger.

10. The apparatus as set forth in claim 8 and further including a first and second fan adapted to circulate air through the outdoor heat exchangers and a set of normally closed first defrost relay contacts which de-energize the first fan when the first outdoor heat exchanger is in a defrost cycle and a set of normally closed second defrost relay contacts to de-energize the second fan when the second outdoor heat exchanger is in a defrost cycle.

11. The apparatus as set forth in claim 8 and further including first and second reversing valves for switching the heat pumps between the cooling and heating modes of operation said reversing valves being set to automatically return to the cooling mode of operation and a set of normally closed first defrost relay contacts in series of the first reversing valve and a set of normally closed second defrost relay contacts in a series with the second reversing valve such that when defrost is initiated for either outdoor heat exchanger, the appropriate reversing valve is de-energized so that heat will be supplied to the outdoor coil for defrost.

12. A method of operating a multiple compressor heat pump system having multiple compressors, multiple outdoor heat exchangers and multiple indoor heat exchangers operatively connected with the compressors, multiple defrost means for the appropriate outdoor heat exchangers, multiple fans associated with the appropriate heat exchangers and multiple reversing valves for changing the refrigerant flow direction within the heat pump operatively associated with each compressor and thermostat means for initiating compressor operation at the appropriate temperature levels, comprising the steps of:

selecting the appropriate mode of operation and number of compressors to be operated as a function of the desired system operation;

energizing a first compressor to transfer heat between a first indoor heat exchanger and a first outdoor heat exchanger under the appropriate loading conditions;

energizing a second compressor to transfer heat from a second outdoor heat exchanger to a second indoor heat exchanger when a first defrost means for the first outdoor heat exchanger is energized;

energizing both the first and second compressors to transfer heat between the first and second outdoor heat exchangers and the first and second indoor heat exchangers under the appropriate loading conditions;

de-energizing a second defrost means associated with the second compressor when the first defrost means associated with the first compressor is energized; and de-energizing the first defrost means associated with the first compressor when the second defrost means associated with the second compressor is energized.

13. The method as set forth in claim 12 and further including the steps of:

de-energizing a first fan when the first outdoor heat exchanger is being defrosted; and de-energizing a second fan when the second outdoor heat exchanger is being defrosted.

14. The method as set forth in claim 12 and further including the steps of:

switching a first reversing valve to the cooling mode of operation when the first outdoor heat exchanger is being defrosted; and switching a second reversing valve to the cooling mode of operation when the second outdoor heat exchanger is being defrosted.

15. The apparatus as set forth in claim 12 and further including the steps of:

testing each outdoor heat exchanger separately and at timed intervals to determine if frost accumulation exists on the outdoor heat exchangers; and initiating defrost when frost accumulation is detected by the step of testing.

* * * * *